US010468777B2

(12) United States Patent
Kawahata

(10) Patent No.: US 10,468,777 B2
(45) Date of Patent: Nov. 5, 2019

(54) LUNEBURG LENS ANTENNA DEVICE

(71) Applicant: Murata Manufacturing Co., Ltd., Kyoto (JP)

(72) Inventor: Kazunari Kawahata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/029,020

(22) Filed: Jul. 6, 2018

(65) Prior Publication Data

US 2019/0058251 A1 Feb. 21, 2019

Related U.S. Application Data

(63) Continuation of application No. PCT/JP2016/085913, filed on Dec. 2, 2016.

(30) Foreign Application Priority Data

Jan. 7, 2016 (JP) ..... 2016-001691

(51) Int. Cl.

| | |
|---|---|
| ***H01Q 3/46*** | (2006.01) |
| ***H01Q 15/08*** | (2006.01) |
| ***H01Q 19/06*** | (2006.01) |
| ***H01Q 21/20*** | (2006.01) |

(52) U.S. Cl.

CPC ..... *H01Q 19/06* (2013.01); *H01Q 3/46* (2013.01); *H01Q 15/08* (2013.01); *H01Q 21/20* (2013.01)

(58) Field of Classification Search

CPC ..... H01Q 9/06; H01Q 9/062; H01Q 15/08
See application file for complete search history.

(56) References Cited

U.S. PATENT DOCUMENTS

| | | | |
|---|---|---|---|
| 4,571,591 | A | 2/1986 | Valentino et al. |
| 6,426,814 | B1 | 7/2002 | Berger |
| 2002/0024477 | A1 | 2/2002 | Foncin |
| 2007/0296640 | A1 | 12/2007 | Colburn et al. |
| 2011/0279338 | A1 | 11/2011 | Myszne |
| 2012/0075158 | A1 | 3/2012 | Kawahata |

(Continued)

FOREIGN PATENT DOCUMENTS

| | | | |
|---|---|---|---|
| DE | 4430832 | A1 * | 11/1995 |
| EP | 3 382 800 | A1 | 10/2018 |

(Continued)

OTHER PUBLICATIONS

International Search Report for International Application No. PCT/JP2016/085913, dated Feb. 7, 2017.

(Continued)

*Primary Examiner* — Robert Karacsony
(74) *Attorney, Agent, or Firm* — Pearne & Gordon LLP

(57) ABSTRACT

A Luneburg lens antenna device includes a Luneburg lens, a plurality of patch antennas, and a plurality of low-frequency antennas. The Luneburg lens is formed in a cylindrical shape and includes three dielectric layers having different dielectric constants and stacked on each other in the radial direction. The plurality of patch antennas respectively include ground electrodes which cover the outer peripheral surface of radiating elements, and form high-frequency MIMO antennas. The plurality of low-frequency antennas are monopole antennas using the ground electrodes, and form low-frequency MIMO antennas.

6 Claims, 11 Drawing Sheets

(56) References Cited

U.S. PATENT DOCUMENTS

| | | | | |
|---|---|---|---|---|
| 2014/0176377 | A1 | 6/2014 | Merlet | |
| 2015/0091767 | A1* | 4/2015 | Matitsine ..... | H01Q 19/06 343/755 |

FOREIGN PATENT DOCUMENTS

| | | | |
|---|---|---|---|
| JP | S63-31304 | A | 2/1988 |
| JP | 2001-352211 | A | 12/2001 |
| WO | 2007/149746 | A2 | 12/2007 |
| WO | 2010/140427 | A1 | 11/2012 |

OTHER PUBLICATIONS

Written Opinion for International Application No. PCT/JP2016/085913, dated Feb. 7, 2017.

Geary, et al., "Single-Feed Dual-Band Stacked Patch Antenna for Orthogonal Circularly Polarized GPS and SDARS Applications", Vehicular Technology Conference, 2008, VTC 2008-Fall, IEEE 68th, IEEE, Piscataway, NJ, USA, Sep. 21, 2008, pp. 1-5.

* cited by examiner

LUNEBURG LENS ANTENNA DEVICE

This is a continuation of International Application No. PCT/JP2016/085913 filed on Dec. 2, 2016 which claims priority from Japanese Patent Application No. 2016-001691 filed on Jan. 7, 2016. The contents of these applications are incorporated herein by reference in their entireties.

BACKGROUND

Technical Field

The present disclosure relates to a Luneburg lens antenna device including a Luneburg lens.

An antenna device that can receive radio waves from plural satellites by using a Luneburg lens is known (see Patent Document 1, for example). In the antenna device disclosed in Patent Document 1, microwave transmit-and-receive modules (primary radiators) are disposed at positions of focal points of a Luneburg lens. This antenna device receives radio waves from a target satellite as a result of changing the receiving direction of radio waves by shifting the positions of the transmit-and-receive modules.

Patent Document 2 discloses a multiband antenna device which uses ground electrodes for radiating elements operating at a high frequency as radiating elements operating at a low frequency.

Patent Document 1: Japanese Unexamined Patent Application Publication No. 2001-352211

Patent Document 2: International Publication No. 2010/140427

BRIEF SUMMARY

In the antenna device disclosed in Patent Document 1, blocking occurs by antenna elements disposed at the plural focal points. Because of the occurrence of blocking, the application of the antenna device to MIMO (multiple-input and multiple-output), for example, is not considered. In the antenna device disclosed in Patent Document 2, a low-frequency antenna and a high-frequency antenna are only singly operated. In this antenna device, however, a low-frequency MIMO antenna and a high-frequency MIMO antenna are not integrated with each other.

The present disclosure has been made in view of the above-described problems of the related art. The present disclosure provides a Luneburg lens antenna device including high-frequency MIMO antennas that form multiple beams including sector beams and low-frequency MIMO antennas.

(1) To solve the above-described problems, a Luneburg lens antenna device according to the present disclosure includes a Luneburg lens and a plurality of patch antennas. The Luneburg lens is formed in a cylindrical shape and has a distribution of different dielectric constants in a radial direction. The plurality of patch antennas is disposed on an outer peripheral surface of the Luneburg lens and at different positions of focal points of the Luneburg lens in a peripheral direction. A plurality of the patch antennas, each includes a radiating element and a ground electrode. The radiating element is disposed on the outer peripheral surface of the Luneburg lens. The ground electrode is positioned at a side opposite to the Luneburg lens as viewed from the radiating element so as to cover the radiating element. In other words, the radiating element is disposed between the Luneburg lens and the ground electrode. Ground electrodes of the plurality of patch antennas are separately disposed in association with the plurality of patch antennas. A plurality of the ground electrodes, each extends linearly in an axial direction (e.g., a direction parallel to a central axis C shown in FIG. 1) of the Luneburg lens and form a low-frequency antenna which is possible to radiate lower-frequency radio waves than radio waves radiated from the patch antennas.

According to the present disclosure, a patch antenna includes a radiating element disposed on the outer peripheral surface of the Luneburg lens and a ground electrode positioned at a side opposite the Luneburg lens as viewed from the radiating element so as to cover the radiating element. With this configuration, as a result of exciting the radiating element, the patch antenna can radiate radio waves toward the Luneburg lens and radiate beams having high directivity in multiple directions. In this case, plural patch antennas disposed on the outer peripheral surface of the Luneburg lens and at different positions of focal points of the Luneburg lens in the peripheral direction may be formed into an array in the axial direction, for example, and be connected to a corresponding transmit-and-receive circuit. As a result of exciting plural patch antennas disposed at different positions in the peripheral direction, it is possible to form high-gain beams in different directions and also to form multiple beams. As a result of forming plural patch antennas into an array in the axial direction, it is possible to obtain high-frequency MIMO antennas that can radiate beams having directivity which is controlled also in an elevation-angle direction.

The plural ground electrodes are separately disposed in association with the patch antennas, and form low-frequency antennas which are possible to radiate lower-frequency radio waves than those radiated from the patch antennas. It is thus possible to form low-frequency MIMO antennas by using the plural low-frequency antennas. The high-frequency MIMO antennas and the low-frequency MIMO antennas can be integrated with each other, thereby making it possible to reduce the size of the entire device to be smaller than when the high-frequency MIMO antennas and the low-frequency MIMO antennas are separately formed.

(2) In the present disclosure, a plurality of the low-frequency antennas is each constituted by a monopole antenna or a dipole antenna, and form, as whole, MIMO antennas. It is thus possible to form omnidirectional MIMO antennas.

(3) In the present disclosure, among a plurality of the low-frequency antennas, a frequency of radio waves radiated from one low-frequency antenna is different from a frequency of radio waves radiated from another low-frequency antenna. It is thus possible to form MIMO antennas of multiple different low-frequency bands.

(4) In the present disclosure, a plurality of the patch antennas are formed in a range which is ½ or smaller of an entire range of the Luneburg lens in the peripheral direction. The plural high-frequency patch antennas can thus form low-sidelobe MIMO antennas without necessarily causing blocking in the patch antennas.

DETAILED DESCRIPTION

Figure 1:
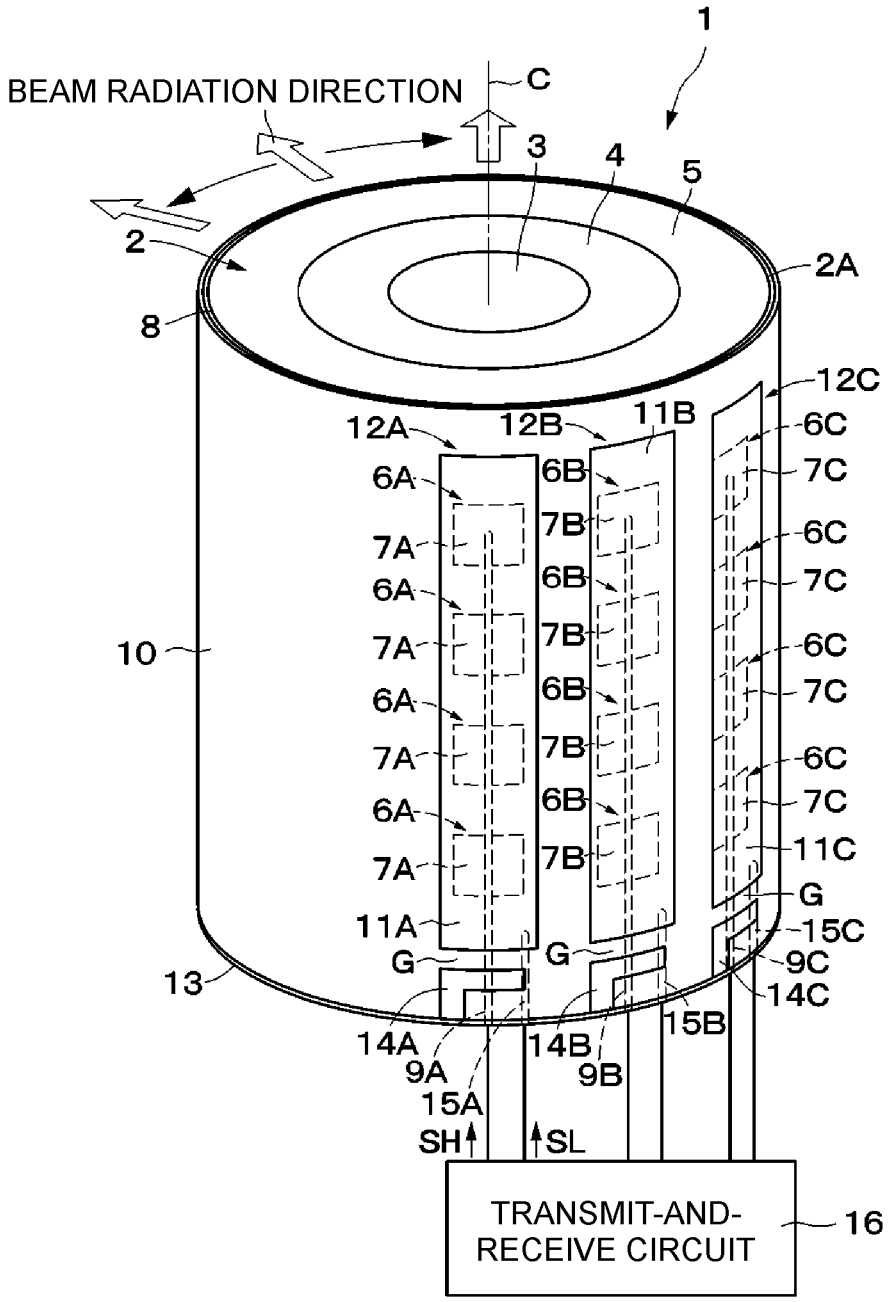
FIG. 1 is a perspective view of a Luneburg lens antenna device according to a first embodiment.

Luneburg lens antenna devices according to embodiments of the present disclosure will be described below in detail with reference to the accompanying drawings.

A Luneburg lens antenna device 1 (hereinafter called the antenna device 1) according to a first embodiment is shown in FIGS. 1 through 12. The antenna device 1 includes a Luneburg lens 2, patch antennas 6A through 6C, and low-frequency antennas 12A through 12C.

The Luneburg lens 2 and the patch antennas 6A through 6C which form high-frequency MIMO antennas will first be discussed below.

The Luneburg lens 2 is formed in a cylindrical shape and has a distribution of different dielectric constants in the radial direction. More specifically, the Luneburg lens 2 includes plural (three, for example) dielectric layers 3 through 5 stacked on each other from the center to the outside portion in the radial direction. The dielectric layers 3 through 5 have different dielectric constants $\varepsilon 1$ through $\varepsilon 3$, respectively, which are decreased in stages from the center (central axis C) to the outside portion in the radial direction. The cylindrical dielectric layer 3 positioned at the center in the radial direction has the largest dielectric constant, the tubular dielectric layer 4 which covers the outer peripheral surface of the dielectric layer 3 has the second largest dielectric constant, and the tubular dielectric layer 5 which covers the outer peripheral surface of the dielectric layer 4 has the smallest dielectric constant ($\varepsilon 1 > \varepsilon 2 > \varepsilon 3$). The Luneburg lens 2 configured as described above forms a radio wave lens. For electromagnetic waves of a predetermined frequency, the Luneburg lens 2 forms plural focal points at different positions in the peripheral direction on the outer peripheral surface.

In FIG. 1, the Luneburg lens 2 having the three dielectric layers 3 through 5 is shown as an example. However, the present disclosure is not restricted to this type of Luneburg lens. The Luneburg lens may have two dielectric layers or four or more dielectric layers. If dielectric layers are constituted by materials having different dielectric constants stacked on each other, thermo-compression bonding is typically used for stacking the materials. In this case, at the interface between two materials, a layer having a dielectric constant different from those of the two materials may be formed because of the influence of mutual diffusion, for example. FIG. 1 shows an example in which the dielectric constant changes in a stepwise manner (in stages) in the radial direction of the Luneburg lens. However, the dielectric constant may change gradually (continuously) in the radial direction of the Luneburg lens.

The plural (twelve, for example) patch antennas 6A through 6C respectively include radiating elements 7A through 7C, first power supply electrodes 9A through 9C, and ground electrodes 11A through 11C. These patch antennas 6A through 6C allow radio waves to pass through the Luneburg lens 2 and then radiate them. Beams passing through the Luneburg lens 2 have thus high directivity and can reach a far side. These patch antennas 6A through 6C form high-frequency antennas that radiate radio waves of a higher frequency band than those from the low-frequency antennas 12A through 12C, which will be discussed later.

The twelve patch antennas 6A through 6C are provided on an outer peripheral surface 2A of the Luneburg lens 2, that is, on the outer peripheral surface of the outermost dielectric layer 5. The patch antennas 6A through 6C are disposed at different positions in the peripheral direction and in the axial direction in a matrix form (four rows by three columns). That is, each column of the twelve patch antennas 6A through 6C forms a linear array antenna.

The patch antennas 6A through 6C respectively include the radiating elements 7A through 7C formed of, for example, rectangular conductive film (metal film) extending in the peripheral direction and in the axial direction of the Luneburg lens 2. These radiating elements 7A through 7C are connected to the first power supply electrodes 9A through 9C, respectively. Upon receiving a high-frequency signal SH from the first power supply electrodes 9A through 9C, the radiating elements 7A through 7C are excited. The patch antennas 6A through 6C are thus able to send or receive high-frequency signals, such as submillimeter-wave and millimeter-wave signals, in accordance with the lengths of the patch antennas 6A through 6C, for example.

On the outer peripheral surface 2A of the Luneburg lens 2, an insulating layer 8 is provided to cover all the radiating elements 7A through 7C. The insulating layer 8 is constituted by a tubular coating member and includes a contact layer, for example, for closely contacting the dielectric layer 5 and the radiating elements 7A through 7C of the Luneburg lens 2. The insulating layer 8 can have a smaller dielectric constant than that of the dielectric layer 5. The insulating layer 8 covers the entirety of the outer peripheral surface 2A of the Luneburg lens 2.

Figure 4:
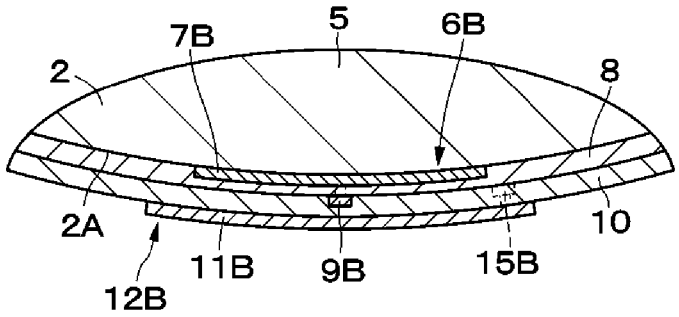
FIG. 4 is an enlarged sectional view of major portions including a patch antenna and a low-frequency antenna, as viewed from the direction of the arrows IV-IV of FIG. 3.

The first power supply electrodes 9A through 9C are formed of long and narrow conductive film and are provided on the outer peripheral surface of the insulating layer 8 (see FIG. 4). The first power supply electrode 9A extends in the axial direction along the four radiating elements 7A and is connected at its leading portion to each of the four radiating elements 7A. The first power supply electrode 9B extends in the axial direction along the four radiating elements 7B and is connected at its leading portion to each of the four radiating elements 7B. The first power supply electrode 9C extends in the axial direction along the four radiating elements 7C and is connected at its leading portion to each of the four radiating elements 7C. The base end portions of the first power supply electrodes 9A through 9C are connected to a transmit-and-receive circuit 16. The first power supply electrodes 9A through 9C form input and output terminals used in MIMO.

On the outer peripheral surface of the insulating layer 8, an insulating layer 10 is provided to cover the first power supply electrodes 9A through 9C. The insulating layer 10 can be formed of various resin materials having insulation properties. The insulating layer 10 covers at least part of the outer peripheral surface 2A of the Luneburg lens 2.

Figure 2:
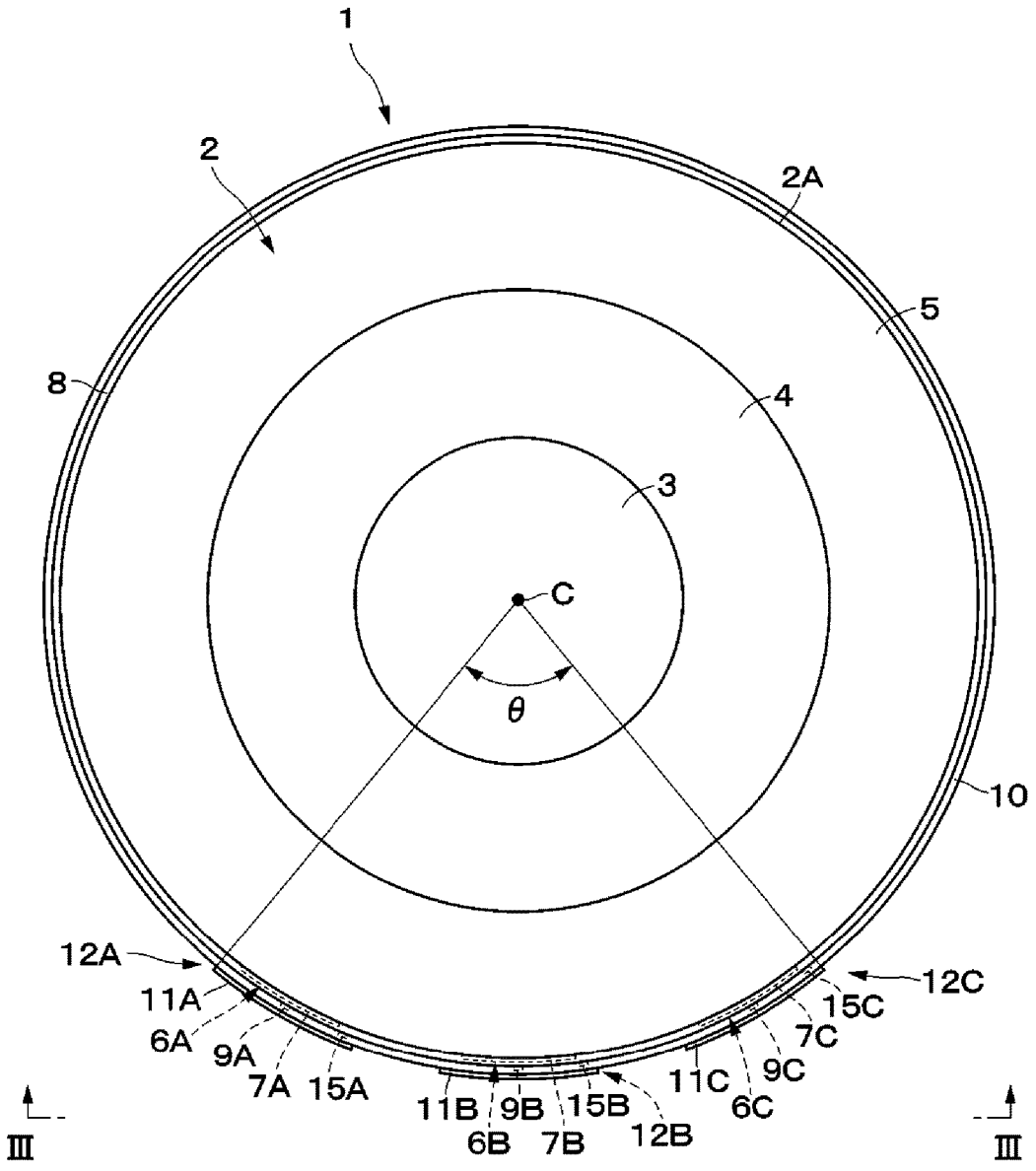
FIG. 2 is a plan view of the Luneburg lens antenna device shown in FIG. 1.
Figure 3:
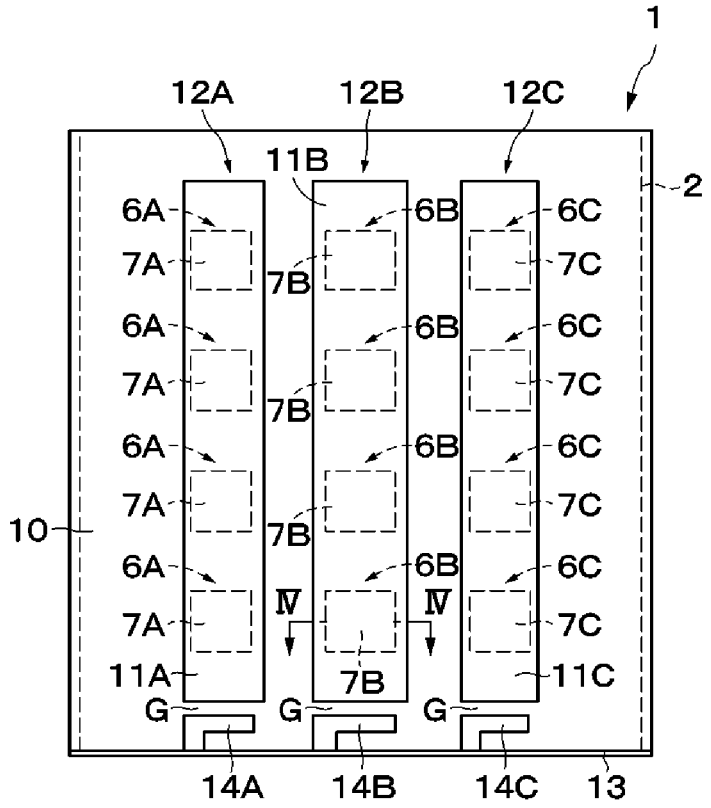
FIG. 3 is a front view of the Luneburg lens antenna device, as viewed from the direction of the arrows III-III of FIG. 2.

The ground electrodes 11A through 11C are provided on the outer peripheral surface of the insulating layer 10. As shown in FIGS. 1 through 3, the ground electrodes 11A through 11C are provided separately from each other in the peripheral direction in association with the three columns of patch antennas 6A through 6C disposed at different positions in the peripheral direction. The ground electrode 11A covers the four patch antennas 6A disposed in the axial direction. Likewise, the ground electrode 11B covers the four patch antennas 6B, and the ground electrode 11C covers the four patch antennas 6C.

The ground electrodes 11A through 11C are formed of, for example, strip-like conductive film (metal film) extending in the axial direction of the Luneburg lens 2. The ground electrodes 11A through 11C are electrically connected to an external ground via capacitance Cg (not shown) generated between the ground electrodes 11A through 11C and connecting electrodes 14A through 14C, respectively, which will be discussed later, so that the ground electrodes of the high-frequency patch antennas can be connected to a ground. The capacitance Cg may be a component, such as a capacitor. In the band of the high-frequency signal SH, the ground electrodes 11A through 11C are maintained at a ground potential. This allows the ground electrodes 11A through 11C to serve as a ground in a high-frequency band when the patch antennas 6A through 6C are operated.

If the patch antennas 6A through 6C are formed in a large angle range θ, part of the radiating elements 7A through 7C and the ground electrodes 11 may block radio waves. To allow for the occurrence of blocking, the array antennas constituted by the plural patch antennas 6A through 6C can be formed in an angle range θ of 180 degrees or smaller and in a range which is ½ or smaller of the entire range of the Luneburg lens 2 in the peripheral direction. In this example, the plural patch antennas 6A through 6C are formed in a range which is ½ or smaller of the entire range of the Luneburg lens 2 in the peripheral direction.

As shown in FIGS. 1 through 3, the four patch antennas 6A are disposed at the same position in the peripheral direction and are also positioned on one side of the patch antennas 6A through 6C in the peripheral direction (the counterclockwise base end portion of the patch antennas 6A through 6C in FIG. 2). The four patch antennas 6A are disposed at equal intervals in the axial direction, for example.

The four patch antennas 6B are disposed at the same position in the peripheral direction and are also positioned at the center of the patch antennas 6A through 6C in the peripheral direction. The four patch antennas 6B are thus located at a position at which they are sandwiched between the patch antennas 6A and 6C. The four patch antennas 6B are disposed at equal intervals in the axial direction, for example.

The four patch antennas 6C are disposed at the same position in the peripheral direction and are also positioned on the other side of the patch antennas 6A through 6C in the peripheral direction (the counterclockwise terminating end portion of the patch antennas 6A through 6C in FIG. 2). The four patch antennas 6C are disposed at equal intervals in the axial direction, for example. The patch antennas 6A, 6B, and 6C are disposed in different columns and are able to send or receive high-frequency signals independently of each other. Because of this configuration, the patch antennas 6A through 6C are applicable to, for example, MIMO having plural input and output terminals in the peripheral direction. The patch antennas 6A through 6C are also disposed side by side at equal intervals in the peripheral direction, for example.

Figure 7:
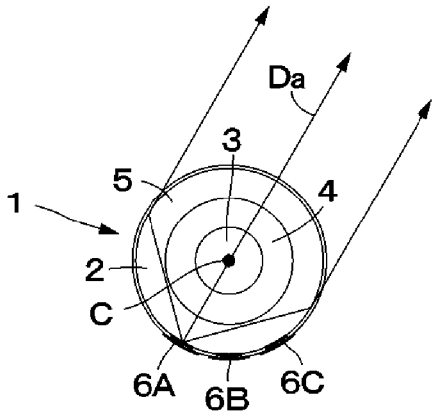
FIG. 7 is a view for explaining a state in which a high-frequency signal is radiated by a patch antenna disposed at one side in the peripheral direction.

The operation of each of the array antennas constituted by the patch antennas 6A through 6C will be discussed below. A description will be given, assuming that operations of the patch antennas 6A through 6C as performed in MIMO are not combined. As shown in FIG. 7, the four patch antennas 6A form beams having directivity toward the opposite side of the patch antennas 6A with the central axis C of the Luneburg lens 2 therebetween. That is, the four patch antennas 6A form beams having the same directivity with respect to the peripheral direction.

Signals having a predetermined relationship (phase relationship, for example) are supplied from the first power supply electrode 9A to the four patch antennas 6A. This makes the beams formed by the four patch antennas 6A fixed with respect to the axial direction of the Luneburg lens 2.

Figure 8:
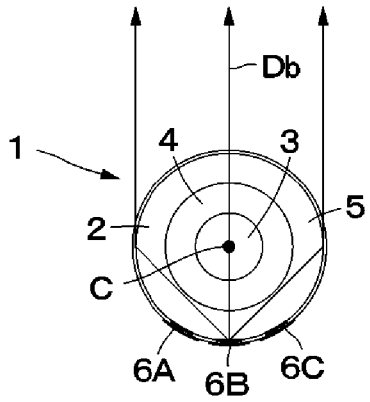
FIG. 8 is a view for explaining a state in which a high-frequency signal is radiated by a patch antenna disposed at the central side in the peripheral direction.

As shown in FIG. 8, the four patch antennas 6B, as well as the patch antennas 6A, form beams having directivity toward the opposite side of the patch antennas 6B with the central axis C of the Luneburg lens 2 therebetween. The patch antennas 6B are disposed at positions different from those of the patch antennas 6A in the peripheral direction of the Luneburg lens 2. Hence, the radiation direction (direction Db) of the beams formed by the patch antennas 6B is different from that (direction Da) of the beams formed by the patch antennas 6A.

Signals having a predetermined relationship are supplied from the first power supply electrode 9B to the four patch antennas 6B. This makes the beams formed by the four patch antennas 6B fixed with respect to the axial direction of the Luneburg lens 2.

Figure 9:
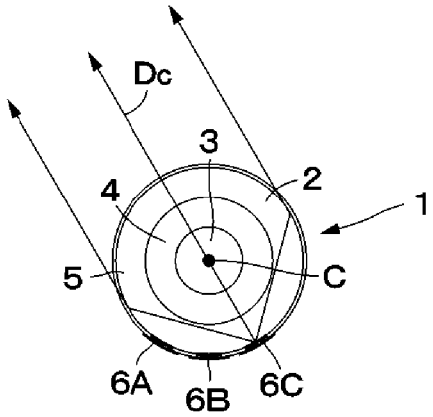
FIG. 9 is a view for explaining a state in which a high-frequency signal is radiated by a patch antenna disposed at the other side in the peripheral direction.

As shown in FIG. 9, the four patch antennas 6C, as well as the patch antennas 6A and 6B, form beams having directivity toward the opposite side of the patch antennas 6C with the central axis C of the Luneburg lens 2 therebetween. The patch antennas 6C are disposed at positions different from those of the patch antennas 6A and 6B in the peripheral direction of the Luneburg lens 2. Hence, the radiation direction (direction Dc) of the beams formed by the patch antennas 6C is different from that (direction Da) of the beams formed by the patch antennas 6A and that (direction Db) of the beams formed by the patch antennas 6B.

Signals having a predetermined relationship are supplied from the first power supply electrode 9C to the four patch antennas 6C. This makes the beams formed by the four patch antennas 6C fixed with respect to the axial direction of the Luneburg lens 2.

The low-frequency antennas 12A through 12C which form low-frequency MIMO antennas will now be discussed below.

The plural (three, for example) low-frequency antennas 12A through 12C respectively include the ground electrodes 11A through 11C, second power supply electrodes 15A through 15C, and a bottom surface ground 13. The ground electrodes 11A through 11C, which also serve as the ground electrodes of the high-frequency antennas, operate as low-frequency radiating antennas. The bottom surface ground 13 serves as a ground electrode for the low-frequency antennas 12A through 12C.

The bottom surface ground 13, which is electrically connected to an external ground, is provided on the bottom surface of the Luneburg lens 2. The bottom surface ground 13 is constituted by a sheet-like or film-like conductor and covers the entirety of the bottom surface of the Luneburg lens 2.

The connecting electrodes 14A through 14C are electrically connected to the bottom surface ground 13. The connecting electrodes 14A through 14C are provided on the outer peripheral surface of the insulating layer 10, for example, and are disposed near the bottom end portions of the ground electrodes 11A through 11C positioned near the bottom surface of the Luneburg lens 2. Gaps G having a predetermined size in the axial direction are formed between the connecting electrodes 14A through 14C and the ground electrodes 11A through 11C, respectively. Accordingly, the ground electrodes 11A through 11C are each electrically connected to the bottom surface ground 13 via the capacitance Cg generated by the gap G.

Figure 5:
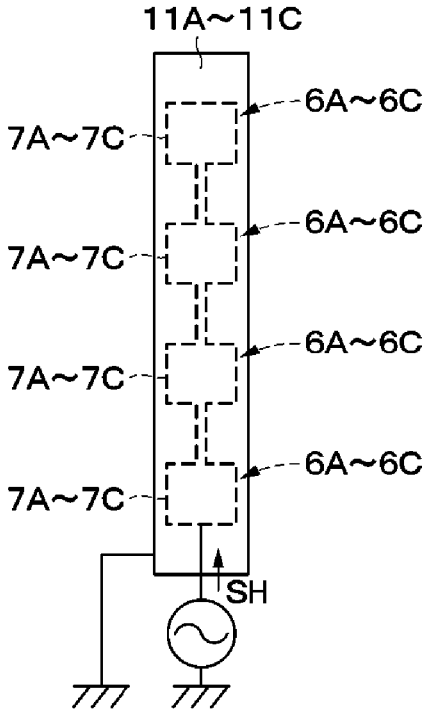
FIG. 5 is a schematic view illustrating a state in which patch antennas are radiating a high-frequency signal.
Figure 6:
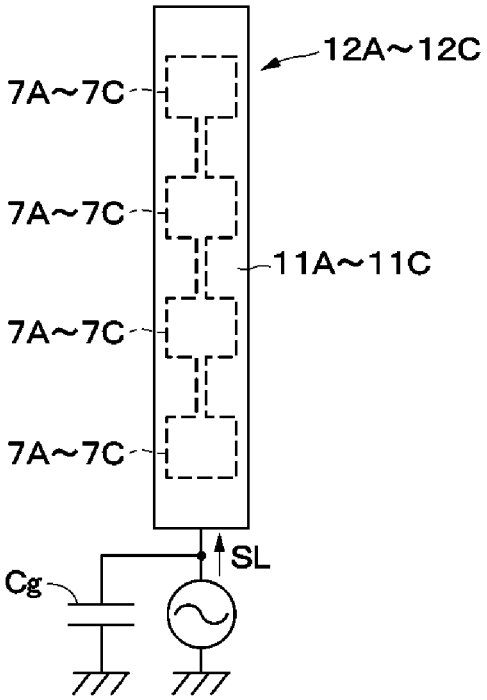
FIG. 6 is a schematic view illustrating a state in which low-frequency antennas are radiating a low-frequency signal.

As shown in FIG. 5, in the band of the high-frequency signal SH, the ground electrodes 11A through 11C are short-circuited with the bottom surface ground 13 by the capacitance Cg. In contrast, as shown in FIG. 6, in the band of a low-frequency signal SL, the ground electrodes 11A through 11C are insulated from the bottom surface ground 13 because of high impedance of the capacitance Cg in the low-frequency band.

The second power supply electrodes 15A through 15C are disposed, together with the first power supply electrodes 9A through 9C, between the insulating layers 8 and 10, for example (see FIG. 4). As power supply units of the low-frequency antennas 12A through 12C, the leading portions of the second power supply electrodes 15A through 15C are electrically connected to the bottom end portions of the ground electrodes 11A through 11C, respectively, near the bottom surface ground 13, for example.

The low-frequency antennas 12A through 12C are constituted by monopole antennas which use the ground electrodes 11A through 11C as radiating elements. Upon receiving the low-frequency signal SL from the second power supply electrodes 15A through 15C, the ground electrodes 11A through 11C are excited. The low-frequency antennas 12A through 12C are thus able to send or receive lower-frequency signals, such as microwave signals, than those sent or received by the patch antennas 6A through 6C, in accordance with the axial-direction lengths of the low-frequency antennas 12A through 12C, for example. The low-frequency antennas 12A through 12C, which are constituted by omnidirectional monopole antennas, are operated as MIMO antennas which radiate waves in all directions around the ground electrodes 11A through 11C, respectively.

The low-frequency antennas 12A, 12B, and 12C are disposed at different positions in the peripheral direction and are able to send or receive low-frequency signals, independently, of each other. The low-frequency antennas 12A through 12C are disposed at an interval of 0.5 wavelengths or longer, for example, in the peripheral direction, and are applicable to low-frequency MIMO having plural input and output terminals. The low-frequency antennas 12A through 12C are disposed at the same position in the axial direction, and are also disposed side by side at equal intervals in the peripheral direction.

The transmit-and-receive circuit 16 is connected to the radiating elements 7A through 7C of the patch antennas 6A through 6C via the first power supply electrodes 9A through 9C, respectively. The transmit-and-receive circuit 16 is able to transmit and receive the high-frequency signals SH independently to and from the patch antennas 6A through 6C disposed at different positions in the peripheral direction. The transmit-and-receive circuit 16 can thus scan beams over a predetermined angle range θ. As a result of the transmit-and-receive circuit 16 supplying power to at least two columns of the patch antennas 6A through 6C together, the patch antennas which have received power can form multiple beams (sector beams).

The transmit-and-receive circuit 16 is also connected to the ground electrodes 11A through 11C, which serve as radiating elements of the low-frequency antennas 12A through 12C, via the second power supply electrodes 15A through 15C, respectively. The transmit-and-receive circuit 16 is able to transmit and receive the low-frequency signals LH independently to and from the low-frequency antennas 12A through 12C disposed at different positions in the peripheral direction.

The operation of the antenna device 1 according to this embodiment will be described below with reference to FIGS. 7 through 12.

When the high-frequency signal SH is supplied from the first power supply electrode 9A to the radiating elements 7A, a current flows through the radiating elements 7A in the axial direction, for example. The patch antennas 6A then radiate a high-frequency signal toward the Luneburg lens 2 in accordance with the axial-direction length of the patch antennas 6A. As a result, as shown in FIG. 7, the antenna device 1 can radiate a high-frequency signal (beam) in the direction Da toward the opposite side of the patch antennas 6A with the central axis C of the Luneburg lens 2 therebetween. The antenna device 1 can also receive a high-frequency signal coming from the direction Da by using the patch antennas 6A.

Likewise, as shown in FIG. 8, when the high-frequency signal SH is supplied from the first power supply electrode 9B to the radiating elements 7B, the antenna device 1 can transmit a high-frequency signal in the direction Db toward the opposite side of the patch antennas 6B with the central axis C of the Luneburg lens 2 therebetween and can also receive a high-frequency signal coming from the direction Db.

As shown in FIG. 9, when the high-frequency signal SH is supplied from the first power supply electrode 9C to the radiating elements 7C, the antenna device 1 can transmit a high-frequency signal in the direction Dc toward the opposite side of the patch antenna 6C with the central axis C of the Luneburg lens 2 therebetween and can also receive a high-frequency signal coming from the direction Dc.

By using both of the patch antennas 6A and 6B, the radiation direction of beams may be adjusted in a range between the directions Da and Db. Similarly, by using both of the patch antennas 6B and 6C, the radiation direction of beams may be adjusted in a range between the directions Db and Dc. This enables the antenna device 1 to radiate beams in a desirable direction within a range between the directions Da and Dc.

In the above-described example, by causing a current to flow through the patch antennas 6A through 6C in the axial direction, the patch antennas 6A through 6C radiate vertically polarized electromagnetic waves. However, the present disclosure is not restricted to this example. By causing a current to flow through the patch antennas 6A through 6C in the peripheral direction, the patch antennas 6A through 6C may radiate horizontally polarized electromagnetic waves. The patch antennas 6A through 6C may radiate circularly polarized electromagnetic waves, for example.

Figure 10:
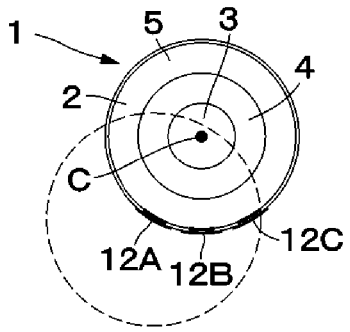
FIG. 10 is a view for explaining a state in which a low-frequency signal is radiated by a low-frequency antenna disposed at one side in the peripheral direction.

When the low-frequency signal SL is supplied from the second power supply electrode 15A to the ground electrode 11A, a current flows through the ground electrode 11A in the axial direction, for example. The low-frequency antenna 12A then radiates a low-frequency signal in accordance with the axial-direction length of the low frequency antenna 12A. As a result, as shown in FIG. 10, by using the low-frequency antenna 12A, the antenna device 1 can radiate a low-frequency signal in all directions around the ground electrode 11A. The antenna device 1 can also receive low-frequency signals coming from all directions by using the low-frequency antenna 12A.

Figure 11:
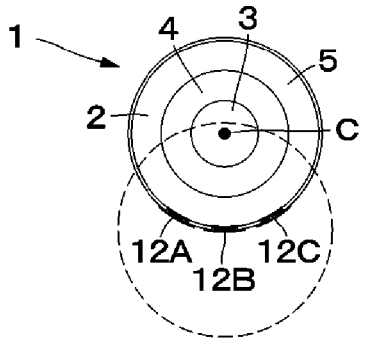
FIG. 11 is a view for explaining a state in which a low-frequency signal is radiated by a low-frequency antenna disposed at the central side in the peripheral direction.

Similarly, as shown in FIG. 11, when the low-frequency signal SL is supplied from the second power supply electrode 15B to the ground electrode 11B, the antenna device 1 can radiate a low-frequency signal in all directions around the ground electrode 11B by using the low-frequency antenna 12B. The antenna device 1 can also receive low-frequency signals coming from all directions by using the low-frequency antenna 12B.

Figure 12:
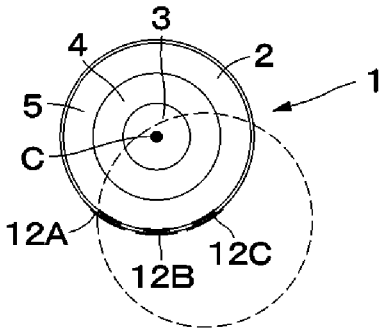
FIG. 12 is a view for explaining a state in which a low-frequency signal is radiated by a low-frequency antenna disposed at the other side in the peripheral direction.
Figure 13:
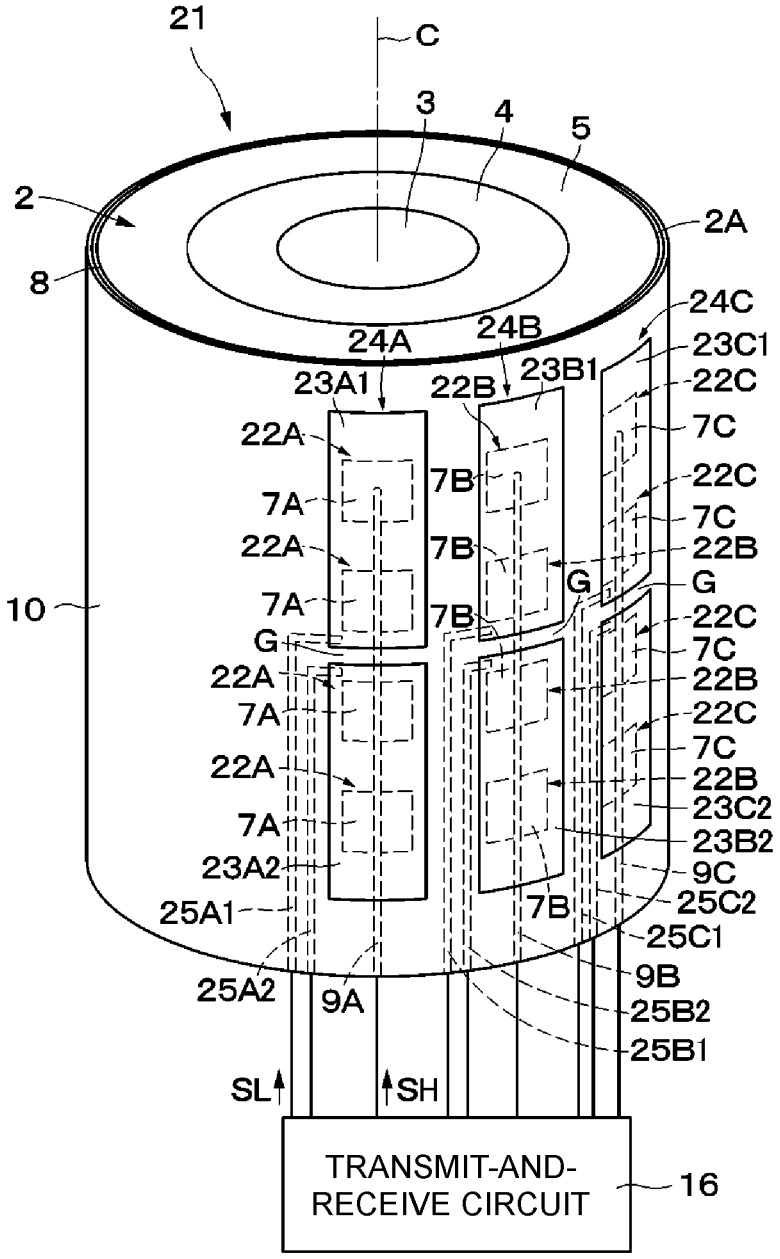
FIG. 13 is a perspective view of a Luneburg lens antenna device according to a second embodiment.
Figure 14:
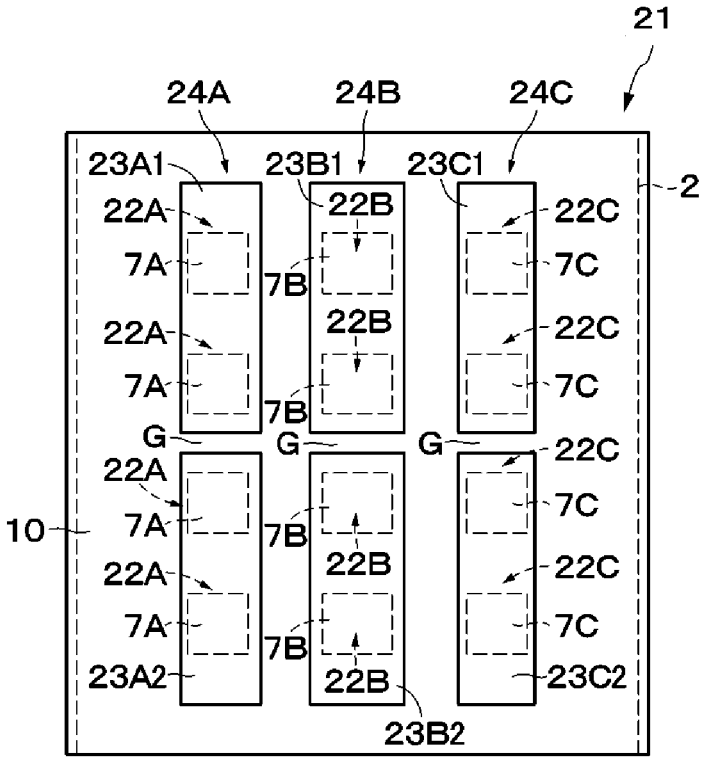
FIG. 14 is a front view of the Luneburg lens antenna device according to the second embodiment, as viewed from a direction similar to that in FIG. 3.

As shown in FIG. 12, when the low-frequency signal SL is supplied from the second power supply electrode 15C to the ground electrode 11C, the antenna device 1 can radiate a low-frequency signal in all directions around the ground electrode 11C by using the low-frequency antenna 12C. The antenna device 1 can also receive low-frequency signals coming from all directions by using the low-frequency antenna 12C.

In the first embodiment, the antenna device 1 includes the plural patch antennas 6A through 6C disposed on the outer peripheral surface 2A of the Luneburg lens 2 and at different positions of focal points of the Luneburg lens 2 in the peripheral direction. Using of the plural patch antennas 6A through 6C disposed at different positions in the peripheral direction can form low-sidelobe beams in different directions. Operating the patch antennas 6A through 6C together can also form multiple beams. As a result, by using the plural patch antennas 6A through 6C, it is possible to form high-frequency MIMO antennas that can radiate multiple beams having high directivity including sector beams. Patch antennas in each array of the plural patch antennas 6A through 6C are provided at different positions in the axial direction. This configuration makes it possible to make the beamwidth narrow in the axial direction, thereby increasing the antenna gain.

The plural ground electrodes 11A through 11C are provided separately from each other in association with the patch antennas 6A through 6C, respectively, and form the low-frequency antennas 12A through 12C that can radiate lower-frequency radio waves than those radiated from the patch antennas 6A through 6C, respectively. It is thus possible to form low-frequency MIMO antennas by using the plural low-frequency antennas 12A through 12C. The high-frequency MIMO antennas and the low-frequency MIMO antennas can thus be integrated, thereby making it possible to reduce the size of the entire device to be smaller than when the high-frequency MIMO antennas and the low-frequency MIMO antennas are separately formed. The low-frequency antennas 12A through 12C are constituted by monopole antennas, thereby making it possible to form omnidirectional MIMO antennas.

Additionally, the plural patch antennas 6A through 6C are formed in a range which is ½ or smaller of the entire range of the Luneburg lens 2 in the peripheral direction. It is thus possible to scan beams in the peripheral direction in accordance with the range of the plural patch antennas 6A through 6C in the peripheral direction. The plural high-frequency patch antennas 6A through 6C can form low-sidelobe MIMO antennas without necessarily causing blocking in the patch antennas 6A through 6C.

The Luneburg lens 2 is formed in a cylindrical shape, so that the first power supply electrodes 9A through 9C, which serve as signal connecting lines, can be formed on the outer peripheral surface 2A of the Luneburg lens 2. The antenna device 1 can thus extract signals more easily than when it uses a spherical Luneburg lens.

Among the plural patch antennas 6A through 6C, patch antennas disposed at different positions in the axial direction of the Luneburg lens 2 are operated mutually dependently. In this case, plural patch antennas disposed at different positions in the axial direction of the Luneburg lens 2 (four patch antennas 6A, for example) are not formed as a MIMO configuration, but plural patch antennas 6A through 6C disposed at different positions in the peripheral direction of the Luneburg lens 2 are formed as a MIMO configuration. Signals having a predetermined relationship, such as signals having a fixed phase difference, are supplied to the four patch antennas 6A arranged in the axial direction, thereby making beams fixed with respect to the axial direction. This point also applies to the patch antennas 6B and 6C. Among the patch antennas 6A through 6C, patch antennas arranged in the axial direction can be connected to each other by a passive circuit, such as a fixed phase shifter. That is, signals are independently supplied to the three columns of the patch antennas 6A through 6C disposed at different positions in the peripheral direction. As a result, fewer input and output circuits are required for the transmit-and-receive circuit 16, thereby making it possible to simplify the configuration of the antenna device 1.

A Luneburg lens antenna device 21 (hereinafter called the antenna device 21) according to a second embodiment of the present disclosure is shown in FIGS. 13 through 16. The second embodiment is characterized in that low-frequency antennas are constituted by dipole antennas. While describing the antenna device 21, elements having the same configurations as those of the antenna device 1 of the first embodiment are designated by like reference numerals, and an explanation thereof will thus be omitted.

The configuration of the antenna device 21 according to the second embodiment is basically similar to that of the antenna device 1 according to the first embodiment. The antenna device 21 includes the Luneburg lens 2, patch antennas 22A through 22C, and low-frequency antennas 24A through 24C.

The configuration of the plural (twelve, for example) patch antennas 22A through 22C is basically similar to that of the patch antennas 6A through 6C of the first embodiment. The patch antennas 22A through 22C include radiating elements 7A through 7C, first power supply electrodes 9A through 9C, and ground electrodes 23A1 through 23C1 and 23A2 through 23C2.

The ground electrodes 23A1 through 23C1 and 23A2 through 23C2 are provided on the outer peripheral surface of the insulating layer 10. The ground electrodes 23A1 and 23A2, the ground electrodes 23B1 and 23B2, and the ground electrodes 23C1 and 23C2 are provided separately from each other in the peripheral direction in association with the three columns of patch antennas 22A through 22C disposed at different positions in the peripheral direction. The ground electrodes 23A1 through 23C1 and 23A2 through 23C2, as well as the ground electrodes 11A through 11C of the first embodiment, are formed of strip-like conductive film (metal film) extending in the axial direction of the Luneburg lens 2. The ground electrodes 23A1 and 23A2 cover the radiating elements 7A, the ground electrodes 23B1 and 23B2 cover the radiating elements 7B, and the ground electrodes 23C1 and 23C2 cover the radiating elements 7C.

The ground electrodes 23A1 and 23A2 disposed at the same position in the peripheral direction are separated from each other at the intermediate position in the axial direction. Likewise, the ground electrodes 23B1 and 23B2 are separated from each other at the intermediate position in the axial direction, and the ground electrodes 23C1 and 23C2 are separated from each other at the intermediate position in the axial direction. Gaps G having a predetermined size in the axial direction are formed between the ground electrodes 23A1 through 23C1 and the ground electrodes 23A2 through 23C2, respectively.

Figure 15:
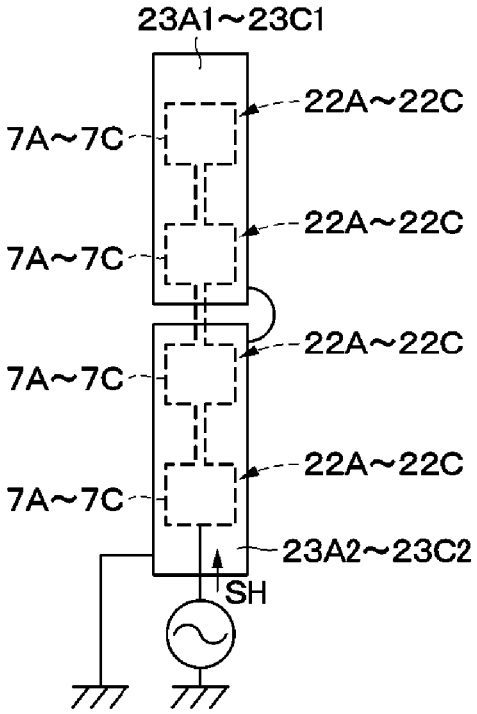
FIG. 15 is a schematic view illustrating a state in which patch antennas are radiating a high-frequency signal.
Figure 16:
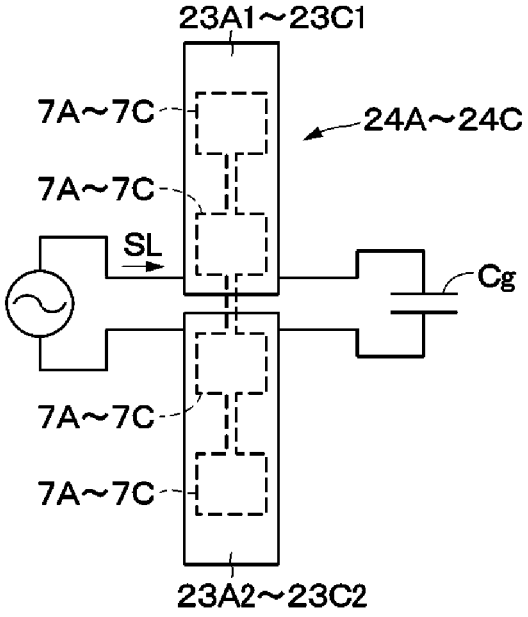
FIG. 16 is a schematic view illustrating a state in which low-frequency antennas are radiating a low-frequency signal.

The ground electrodes 23A2 through 23C2 are respectively connected to an external ground by second power supply electrodes 25A2 through 25C2, which will be discussed later. In the band of the high-frequency signal SH, the ground electrodes 23A1 through 23C1 and the ground electrodes 23A2 through 23C2 are connected to each other by the capacitance Cg. As shown in FIG. 15, in the band of the high-frequency signal SH, the ground electrodes 23A1 through 23C1 and 23A2 through 23C2, as a whole, are short-circuited with a ground. This allows the ground electrodes 23A2 through 23C2 to serve as reflectors when the patch antennas 6A through 6C are operated. In contrast, as shown in FIG. 16, in the band of the low-frequency signal SL, the ground electrodes 23A1 through 23C1 and the ground electrodes 23A2 through 23C2 are insulated from each other by the capacitance Cg.

The plural (three, for example) low-frequency antennas 24A through 24C include the following elements. The low-frequency antenna 24A includes the ground electrodes 23A1 and 23A2 and the second power supply electrodes 25A1 and 25A2. The low-frequency antenna 24B includes the ground electrodes 23B1 and 23B2 and the second power supply electrodes 25B1 and 25B2. The low-frequency antenna 24C includes the ground electrodes 23C1 and 23C2 and the second power supply electrodes 25C1 and 25C2.

The second power supply electrodes 25A1 through 25C1 and 25A2 through 25C2 are disposed, together with the first power supply electrodes 9A through 9C, between the insulating layers 8 and 10, for example. As power supply units of the low-frequency antennas 24A through 24C, the leading portions of the second power supply electrodes 25A1 through 25C1 are connected to the bottom end portions of the ground electrodes 23A1 through 23C1, respectively, near the gaps G. As power supply units of the low-frequency antennas 24A through 24C, the leading portions of the second power supply electrodes 25A2 through 25C2 are connected to the top end portions of the ground electrodes 23A2 through 23C2, respectively, near the gaps G.

The low-frequency antennas 24A through 24C are constituted by dipole antennas which use the ground electrodes 23A1 through 23C1 and 23A2 through 23C2 as radiating elements. Upon receiving the low-frequency signal SL from the second power supply electrodes 25A1 through 25C1 and 25A2 through 25C2, the ground electrodes 23A1 through 23C1 and 23A2 through 23C2 are excited. The low-frequency antennas 24A through 24C are thus able to send or receive lower-frequency signals, such as microwave signals, than those sent or received by the patch antennas 22A through 22C, in accordance with the axial-direction lengths of the low-frequency antennas 24A through 24C, for example. The low-frequency antennas 24A through 24C, which are constituted by omnidirectional dipole antennas, respectively radiate low-frequency signals in all directions around the ground electrodes 23A1 through 23C1 and 23A2 through 23C2.

In the second embodiment, advantages similar to those of the first embodiment can also be obtained. In the second embodiment, the low-frequency antennas 24A through 24C are constituted by dipole antennas, thereby making it possible to omit the bottom surface ground 13 used in the first embodiment.

Figure 17:
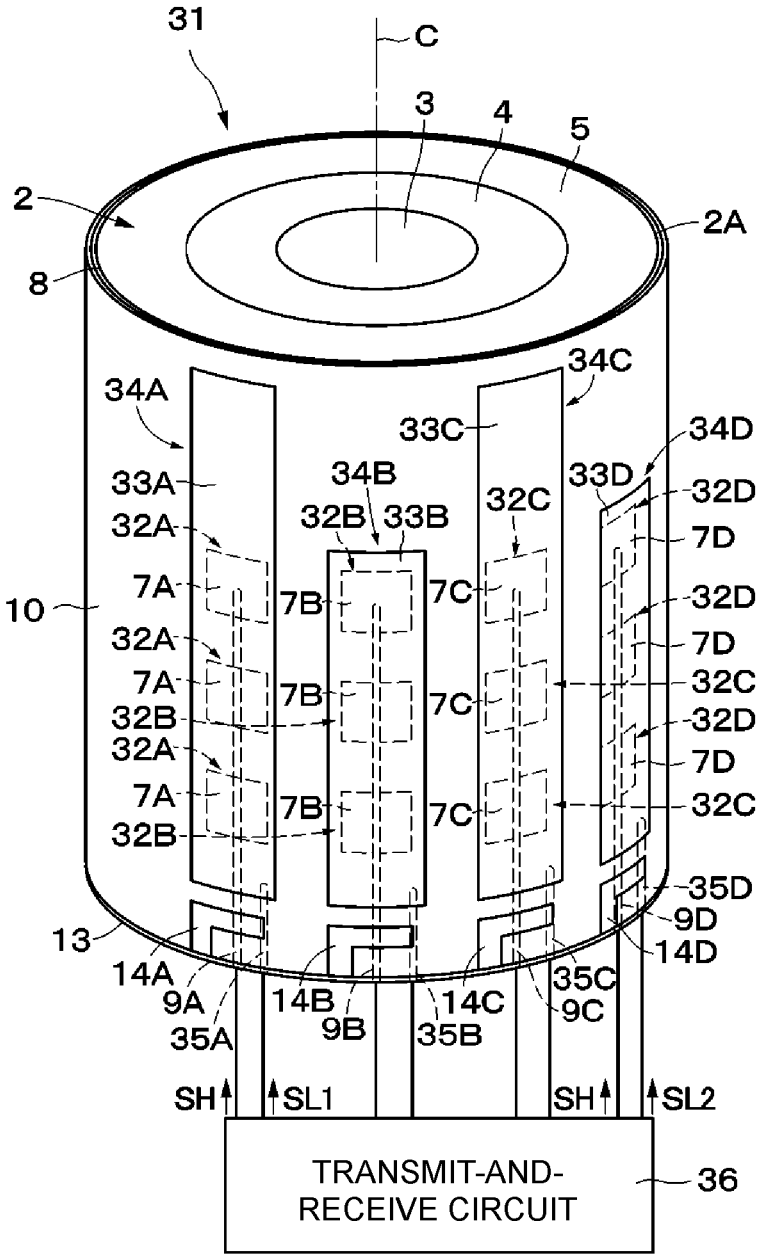
FIG. 17 is a perspective view of a Luneburg lens antenna device according to a third embodiment.
Figure 18:
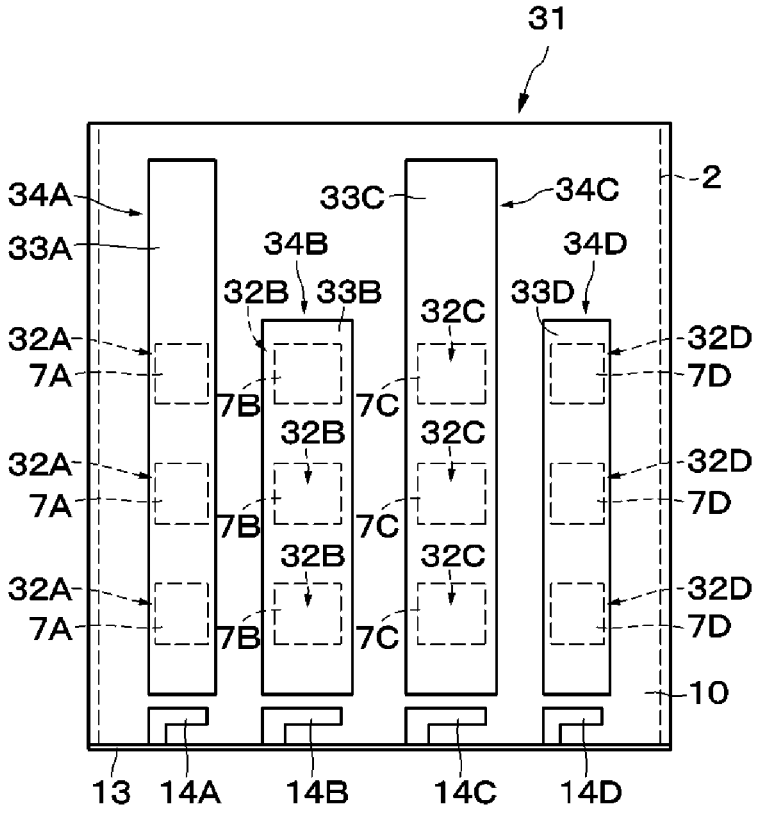
FIG. 18 is a front view of the Luneburg lens antenna device according to the third embodiment, as viewed from a direction similar to that in FIG. 3.

A Luneburg lens antenna device 31 (hereinafter called the antenna device 31) according to a third embodiment of the present disclosure is shown in FIGS. 17 and 18. The third embodiment is characterized in that the antenna device 31 includes two types of low-frequency antennas that radiate radio waves of different frequencies. While describing the antenna device 31, elements having the same configurations as those of the antenna device 1 of the first embodiment are designated by like reference numerals, and an explanation thereof will thus be omitted.

The configuration of the antenna device 31 according to the third embodiment is basically similar to that of the antenna device 1 according to the first embodiment. The antenna device 31 includes the Luneburg lens 2, patch antennas 32A through 32D, and low-frequency antennas 34A through 34D.

The configuration of the plural (twelve, for example) patch antennas 32A through 32D is basically similar to that of the patch antennas 6A through 6C of the first embodiment. The patch antennas 32A through 32D include radiating elements 7A through 7D, first power supply electrodes 9A through 9D, and ground electrodes 33A through 33D.

The patch antennas 32A through 32D are provided separately from each other at four portions of the Luneburg lens 2 in the peripheral direction. The patch antennas 32A through 32D are disposed at different positions in the peripheral direction and in the axial direction in a matrix form (three rows by four columns). The configuration of the radiating element 7D is basically similar to that of the radiating elements 7A through 7C of the first embodiment. The configuration of the first power supply electrode 9D is basically similar to that of the first power supply electrodes 9A through 9C of the first embodiment.

The configuration of the ground electrodes 33A through 33D is basically similar to that of the ground electrodes 11A through 11C of the first embodiment. The ground electrodes 33A through 33D are provided on the outer peripheral surface of the insulating layer 10. The ground electrodes 33A through 33D are provided separately from each other in the peripheral direction in association with the four columns of patch antennas 32A through 32D disposed at different positions in the peripheral direction. The ground electrodes 33A through 33D are formed of strip-like conductive film (metal film) extending in the axial direction of the Luneburg lens 2, and cover the radiating elements 7A through 7D, respectively.

Gaps G having a predetermined size in the axial direction are formed between the bottom end portions of the ground electrodes 33A through 33D and the connecting electrodes 14A through 14D, respectively. The ground electrodes 33A through 33D are connected to the bottom surface ground 13 via the capacitance Cg generated by the gaps G. In the band of the high-frequency signal SH, the ground electrodes 33A through 33D are maintained at a ground potential. This allows the ground electrodes 33A through 33D to serve as reflectors when the patch antennas 32A through 32D are operated.

That is, in the band of the high-frequency signal SH, the ground electrodes 33A through 33D are short-circuited with the bottom surface ground 13 by the capacitance Cg. In contrast, in the bands of low-frequency signals SL1 and SL2, the ground electrodes 33A through 33D are insulated from the bottom surface ground 13 by the capacitance Cg.

The axial-direction lengths of the ground electrodes 33A and 33C are greater than those of the ground electrodes 33B and 33D. The longer ground electrodes 33A and 33C and the shorter ground electrodes 33B and 33D are alternately disposed in the peripheral direction of the Luneburg lens 2.

The plural (four, for example) low-frequency antennas 34A through 34D respectively include the ground electrodes 33A through 33D and second power supply electrodes 35A through 35D.

The configuration of the second power supply electrodes 35A through 35D is basically similar to that of the second power supply electrodes 15A through 15C of the first embodiment. The second power supply electrodes 35A through 35D are disposed, together with the first power supply electrodes 9A through 9D, between the insulating layers 8 and 10, for example. As power supply units of the low-frequency antennas 34A through 34D, the leading portions of the second power supply electrodes 35A through 35D are electrically connected to the bottom end portions of the ground electrodes 33A through 33D, respectively, near the bottom surface ground 13, for example.

The low-frequency antennas 34A through 34D are constituted by monopole antennas which use the ground electrodes 33A through 33D as radiating elements. Upon receiving the low-frequency signals SL1 and SL2 from the second power supply electrodes 35A through 35D, the ground electrodes 33A through 33D are excited.

The axial-direction lengths of the ground electrodes 33A and 33C are longer than those of the ground electrodes 33B and 33D. Hence, the low-frequency antennas 34A and 34C including the ground electrodes 33A and 33C, respectively, are able to send or receive lower-frequency signals than those sent or received by the low-frequency antennas 34B and 34D including the ground electrodes 33B and 33D, respectively. Although the configuration of a transmit-and-receive circuit 36 is basically similar to that of the transmit-and-receive circuit 16 of the first embodiment, the transmit-and-receive circuit 36 supplies the 800-MHz low-frequency signal SL1, for example, to the low-frequency antennas 34A and 34C and supplies the 2-GHz low-frequency signal SL2, for example, to the low-frequency antennas 34B and 34D.

In the third embodiment, advantages similar to those of the first embodiment can also be obtained. In the third embodiment, the frequency of radio waves radiated from the low-frequency antennas 34A and 34C is different from that from the low-frequency antennas 34B and 34D. It is thus possible to form MIMO antennas for the two low-frequency signals SL1 and SL2.

The longer ground electrodes 33A and 33C and the shorter ground electrodes 33B and 33D are alternately disposed in the peripheral direction of the Luneburg lens 2. This configuration can increase the peripheral-direction distance between the low-frequency antennas 34A and 34C used in the same frequency band, so that the low-frequency antennas 34A and 34C can be operated more independently of each other. This point also applies to the low-frequency antennas 34B and 34D.

In the above-described third embodiment, the low-frequency antennas 34A through 34D are constituted by monopole antennas, as in the first embodiment. However, the present disclosure is not restricted to this configuration. The low-frequency antennas may be constituted by dipole antennas, as in the second embodiment.

In the above-described first embodiment, the power supply electrodes 9A through 9C and 15A through 15C are respectively disposed between the patch antennas 6A through 6C and the ground electrodes 11A through 11C. However, the present disclosure is not restricted to this configuration. The power supply electrodes may be provided on the outer side of the ground electrodes in the radial direction. In this case, the power supply electrodes for low-frequency signals may directly be connected to the ground electrodes, and the power supply electrodes for high-frequency signals may be connected to the radiating elements of the patch antennas via through-holes provided in the ground electrodes, for example. This configuration may also be applicable to the second and third embodiments.

In the above-described first embodiment, the patch antennas 6A through 6C are arranged in a matrix of four rows by three columns. In the above-described third embodiment, the patch antennas 32A through 32D are arranged in a matrix of three rows by four columns. However, the present disclosure is not restricted to this configuration. The number and the arrangement of the patch antennas may be adjusted suitably according to the specifications of the antenna device, for example. For example, the plural patch antennas may be arranged linearly in the peripheral direction of the Luneburg lens if they are disposed at different positions of focal points of the Luneburg lens. This configuration may also be applicable to the second embodiment.

In the above-described first embodiment, plural patch antennas disposed at different positions in the axial direction of the Luneburg lens 2 (four patch antennas 6A, for example) are operated mutually dependently. However, the present disclosure is not restricted to this configuration. Signals may independently be supplied to plural patch antennas disposed at different positions in the axial direction so that the patch antennas can operate independently of each other. This makes it possible to adjust the radiation direction and the shape of beams in the axial direction, for example. This configuration may also be applicable to the second and third embodiments.

The above-described embodiments are only examples. The configurations described in the different embodiments may partially be replaced by or combined with each other.

REFERENCE SIGNS LIST

1, 21, 31 Luneburg lens antenna device (antenna device)
2 Luneburg lens
6A to 6C, 22A to 22C, 32A to 32D patch antenna
7A to 7D radiating element

9A to 9D first power supply electrode

11A to 11C, 23A1 to 23C1, 23A2 to 23C2, 33A to 33D ground electrode

12A to 12C, 24A to 24C, 34A to 34D low-frequency antenna

15A to 15C, 25A1 to 25C1, 25A2 to 25C2, 35A to 35D second power supply electrode

16, 36 transmit-and-receive circuit

The invention claimed is:

1. A Luneburg lens antenna device comprising:

a Luneburg lens that is formed in a cylindrical shape and has a distribution of different dielectric constants, wherein the dielectric constants are a function of a radial distance from a central axis of the cylindrical shape; and at least two pluralities of patch antennas that are disposed on an outer peripheral surface of the Luneburg lens at different positions in a peripheral direction, wherein:

each plurality of patch antennas includes at least one radiating element and a ground electrode, the at least one radiating element being disposed on the outer peripheral surface of the Luneburg lens, the ground electrode covering the at least one radiating element with an insulating layer disposed between the at least one radiating element and the ground electrode, each ground electrode is separately disposed, and extends linearly in an axial direction of the Luneburg lens, and the ground electrodes form at least one low-frequency antenna capable of radiating lower-frequency radio waves than the patch antennas.

2. The Luneburg lens antenna device according to claim 1, wherein the ground electrodes form a plurality of low-frequency antennas, each constituting a monopole antenna or a dipole antenna, and wherein the plurality of low-frequency antennas collectively form MIMO antennas.

3. The Luneburg lens antenna device according to claim 1, wherein the ground electrodes form a plurality of low-frequency antennas, and a frequency of radio waves radiated from one of the plurality of low-frequency antennas is different from a frequency of radio waves radiated from another of the plurality of low-frequency antennas.

4. The Luneburg lens antenna device according to claim 1, wherein the pluralities of patch antennas are formed on the outer peripheral surface over a range of 180 degrees or less about the central axis.

5. The Luneburg lens antenna device according to claim 1, wherein the pluralities of patch antennas are formed in an array.

6. The Luneburg lens antenna device according to claim 1, wherein one of the ground electrodes extends a different length linearly in the axial direction of the Luneburg lens than another of the ground electrodes.

* * * * *